US007006082B2

(12) United States Patent
Akai et al.

(10) Patent No.: US 7,006,082 B2
(45) Date of Patent: Feb. 28, 2006

(54) DISPLAY APPARATUS AND DRIVING DEVICE FOR DISPLAYING

(75) Inventors: Akihito Akai, Yokohama (JP); Yasuyuki Kudo, Kamakura (JP); Kazuo Ookado, Kokubunji (JP); Kazunari Kurokawa, Mobara (JP); Atsuhiro Higa, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 143 days.

(21) Appl. No.: 10/161,637

(22) Filed: Jun. 5, 2002

(65) Prior Publication Data

US 2002/0186211 A1 Dec. 12, 2002

(30) Foreign Application Priority Data

Jun. 7, 2001 (JP) ..... 2001-171887

(51) Int. Cl.
*G09G 5/00* (2006.01)

(52) U.S. Cl. ..... 345/204; 345/98

(58) Field of Classification Search ..... 345/204, 345/691, 87, 98, 100
See application file for complete search history.

(56) References Cited

U.S. PATENT DOCUMENTS

| | | | | |
|---|---|---|---|---|
| 5,424,753 A | | 6/1995 | Kitagawa et al. | |
| 5,710,571 A | * | 1/1998 | Kuo | 345/94 |
| 5,796,391 A | * | 8/1998 | Chiu et al. | 345/204 |
| 5,963,188 A | * | 10/1999 | Kim | 345/98 |
| 6,232,945 B1 | * | 5/2001 | Moriyama et al. | 345/98 |
| 6,522,319 B1 | | 2/2003 | Yamazaki | |

FOREIGN PATENT DOCUMENTS

CN 1262761 A 8/2000

* cited by examiner

*Primary Examiner*—Amare Mengistu
(74) *Attorney, Agent, or Firm*—Antonelli, Terry, Stout and Kraus, LLP.

(57) ABSTRACT

A display apparatus and a display drive circuit are disclosed. The display drive circuit comprises a gate line drive circuit and a register. The gate line drive circuit outputs to the pixels a select voltage for selecting the pixels and a non-select voltage for prohibiting the selection of the pixels during one horizontal period. The register sets a non-overlap period for outputting a non-select voltage to at least two lines of pixels on the display panel during one horizontal period.

23 Claims, 10 Drawing Sheets

DISPLAY APPARATUS AND DRIVING DEVICE FOR DISPLAYING

BACKGROUND OF THE INVENTION

The present invention relates to a display apparatus comprising a display panel with display pixels arranged in matrix, and a display drive circuit for selecting the display pixels to be impressed with a gray scale voltage, or in particular to a display apparatus employing liquid crystal, organic EL or plasma and a display drive circuit therefor.

According to JP-A-6-161390 (laid open Jun. 7, 1994), a liquid crystal material is sealed between each of a plurality of pixel electrodes and a corresponding one of opposed electrodes, and the pixel electrodes are each connected with a switching transistor. A scanning signal for turning on/off the switching transistor is applied from a scanning signal supply circuit through a scanning signal line to the switching transistor. An image signal is supplied from an image signal supply circuit through an image signal line and the switching transistor to each pixel electrode. The scanning signal on an adjacent scanning signal line is supplied to the pixel electrode through an additional capacitor. Further, a compensation voltage is applied before and after the voltage level of the scanning signal for turning on the switching transistor. In other words, according to the disclosure of JP-A-6-161390, the off voltage of the scanning signal is changed during the non-overlap period of the scanning signal.

On the other hand, JP-A-11-64821 (laid open Mar. 5, 1993) discloses:

a display panel including an array substrate, an opposed substrate arranged in opposed relation to the array substrate and a light modulation layer held between the array substrate and the opposed substrate, the array substrate having a plurality of signal lines, a plurality of scanning lines and a plurality of pixel electrodes, the signal lines and the scanning lines being arranged to intersect each other, the pixel electrodes being each arranged in the neighborhood of a corresponding one of the intersections between a corresponding one of the signal lines and a corresponding one of the scanning lines through a corresponding one of a plurality of switch elements;

signal line drive means for supplying a video signal voltage to the signal lines; and scanning line drive means for supplying the scanning lines with scanning pulses having a first voltage for turning on the switch elements and a second voltage for turning off the switch elements;

wherein a pixel electrode connected to one of the scanning lines through a switch element electrically forms a capacitor with another scanning line through a dielectric layer, and the turn-on period of the switch element of a given scanning line is not substantially in superposed relation with the turn-on period of another switch element.

Further, JP-A-10-221676 (laid open Aug. 21, 1998) discloses a plurality of V scanners connected with a plurality of gate lines arranged in rows, a plurality of H scanners connected with a plurality of signal lines arranged in columns and a plurality of pixel units arranged at the intersections, respectively, between the gate lines and the signal lines;

wherein the V scanners are divided into first V scanners connected to the odd-number gate lines, respectively, and second V scanners connected to the even-number gate lines, respectively, wherein the nth gate line of the first V scanners is connected in series with a NAND circuit and a buffer circuit, with the unconnected input terminal of the NAND circuit being connected to the end terminal of the (n−1)th gate line of the second V scanners through an inverter circuit, while the nth gate line of the second V scanners is connected in series with a NAND circuit and a buffer circuit, with the unconnected input terminal of the NAND circuit being connected to the end terminal of the (n−1)th gate line of the first V scanners through an inverter circuit, thereby preventing the gate lines from being selected in overlapped relation, and wherein a selective pulse is supplied to every other gate through the buffer circuits and the NAND circuits connected to the first and second V scanners so that adjacent gate pulses are not overlapped with each other.

One scanning period is set by a line pulse, and one frame period is set as the product of one scanning period and the number of drive lines. The gate pulse applies a gate line select voltage to the first line in synchronism with the trailing edge of the line pulse when the frame pulse is at high level. After that, the gate pulse is applied to subsequent lines sequentially in synchronism with the line pulse. In the case where the output of the gate driver is used for a panel configured of an additional capacitor Cadd, for example, the black display brightness of normally black liquid crystal increases, thereby sometimes making it impossible to obtain the proper contrast. This abnormal increase in display brightness is attributable to the fact that the liquid panel is configured of a Cadd. The pixel electrodes are each connected to the gate line in the preceding stage through a Cadd. When a high-level voltage is applied to the gate line in the preceding stage, the pixel electrode is changed to high-voltage side through the Cadd, resulting in a correspondingly abnormal increase in display brightness.

None of the conventional techniques described above, however, takes note of the abnormal increase in display brightness with a reduced contrast.

SUMMARY OF THE INVENTION

An object of the present invention is to provide a display apparatus and a display drive circuit with an improved contrast.

Another object of the invention is to provide a display apparatus and a display drive circuit with a reduced power consumption.

The voltage fluctuation of the pixel electrodes due to the gate pulse may be reduced by a method for reducing the amplitude of the gate pulse or a method for reducing the pulse width of the gate pulse. In view of the fact that the former method involves a voltage required for turning on/off a TFT, the gate pulse width of the latter method has been employed by the invention.

In order to achieve these objects, according to this invention, there is provided a display apparatus and a display drive circuit, wherein a non-overlap period can be set for outputting a non-select voltage to the pixels for at least two lines of the display panel during one horizontal period. In other words, a period with the non-select signal level of the gate pulse signal during which the pixels are not selected is set in one horizontal period. In this way, the contrast can be improved.

Also, in order to achieve the objects described above, according to this invention, there is provided a display apparatus and a display drive circuit, wherein the frequency of the gate pulse signal is relatively increased during a display area-related period in which the display data are displayed, while the frequency of the gate pulse signal is relatively decreased for a non-display area-related period in which the display data are not displayed.

Other objects, features and advantages of the invention will become apparent from the following description of the embodiments of the invention taken in conjunction with the accompanying drawings.

DETAILED DESCRIPTION OF THE EMBODIMENTS

Figure 1A:
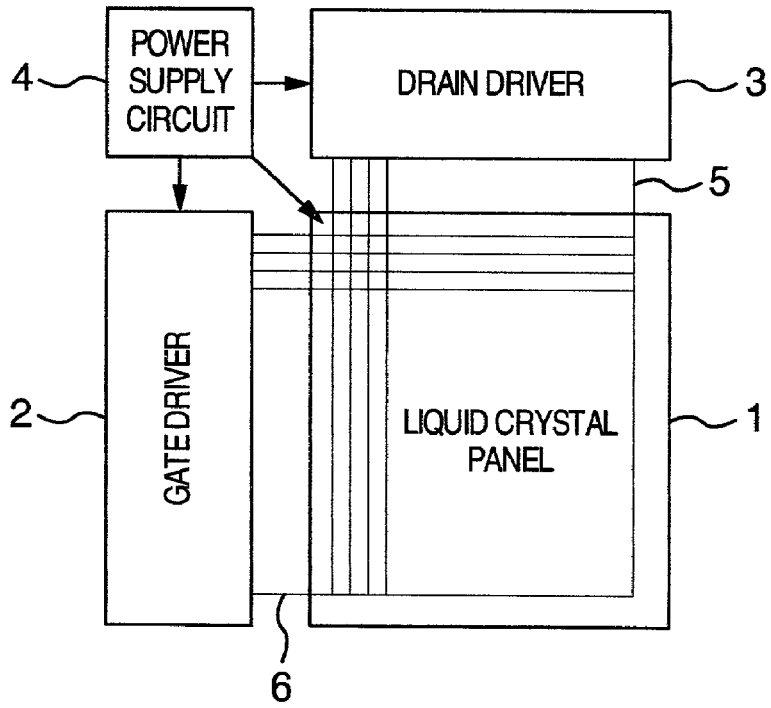
FIGS. 1A and 1B are diagrams for explaining a structure of a liquid crystal display apparatus.
Figure 1B:
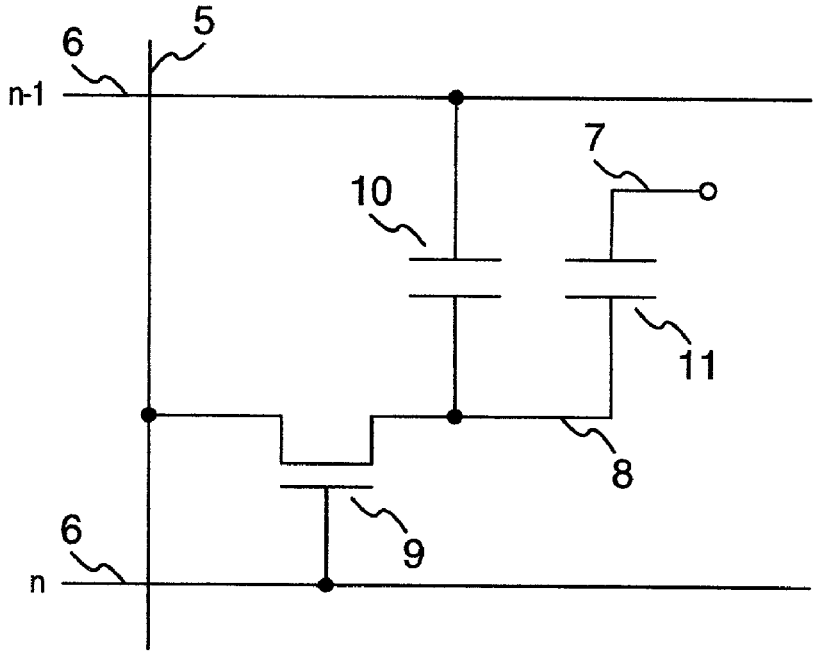

FIG. 1A is a diagram showing the structure of a liquid crystal display apparatus, and FIG. 1B a diagram showing the configuration of a pixel unit. The liquid crystal display apparatus comprises a liquid crystal panel 1 having pixels arranged in matrix, a drain driver 3 for generating a gray scale voltage corresponding to the display data and applying it to each pixel of the liquid crystal panel, a gate driver 2 for selecting (scanning the liquid crystal panel) pixels, line by line, to which the gray scale voltage is applied, and a power supply circuit 4 for generating and supplying a source voltage to the drain driver 3 and the gate driver 2. Among these component parts, the liquid crystal panel 1 has a TFT (thin film transistor) 9 for each pixel. Drain lines 5 and gate lines 6 connected to the TFTs are arranged in matrix. The source of each TFT 9 is connected to a corresponding pixel electrode 8. The pixel electrode 8 controls the display brightness based on the difference of the applied voltage with respect to a common electrode 7 arranged on the other side of the liquid crystal 11. The drain driver 3 outputs a gray scale voltage to each drain line 5, while the power supply circuit 4 supplies a drive voltage to the drain driver 3 and the gate driver 2 on the one hand and outputs a common voltage to the common electrode 7 on the other hand. The gate driver 2 outputs a timing pulse indicating a select period to the gate lines. One scanning period (the period for selecting pixels for one line) is set by a line pulse, and one frame period is set as the product of one scanning period and the number of driven lines. The gate pulse applies a gate line select voltage to the head line in synchronism with the trailing edge of the line pulse when the frame pulse is at high level. After that, the gate pulse is applied to next and subsequent lines sequentially in synchronism with the line pulse. The gate driver 2 may select the pixels sequentially for either each line or a plurality of lines. Each pixel electrode 8 is connected to the gate line 6 in the preceding stage ((n−1)th stage) through a Cadd 10.

Figure 2:
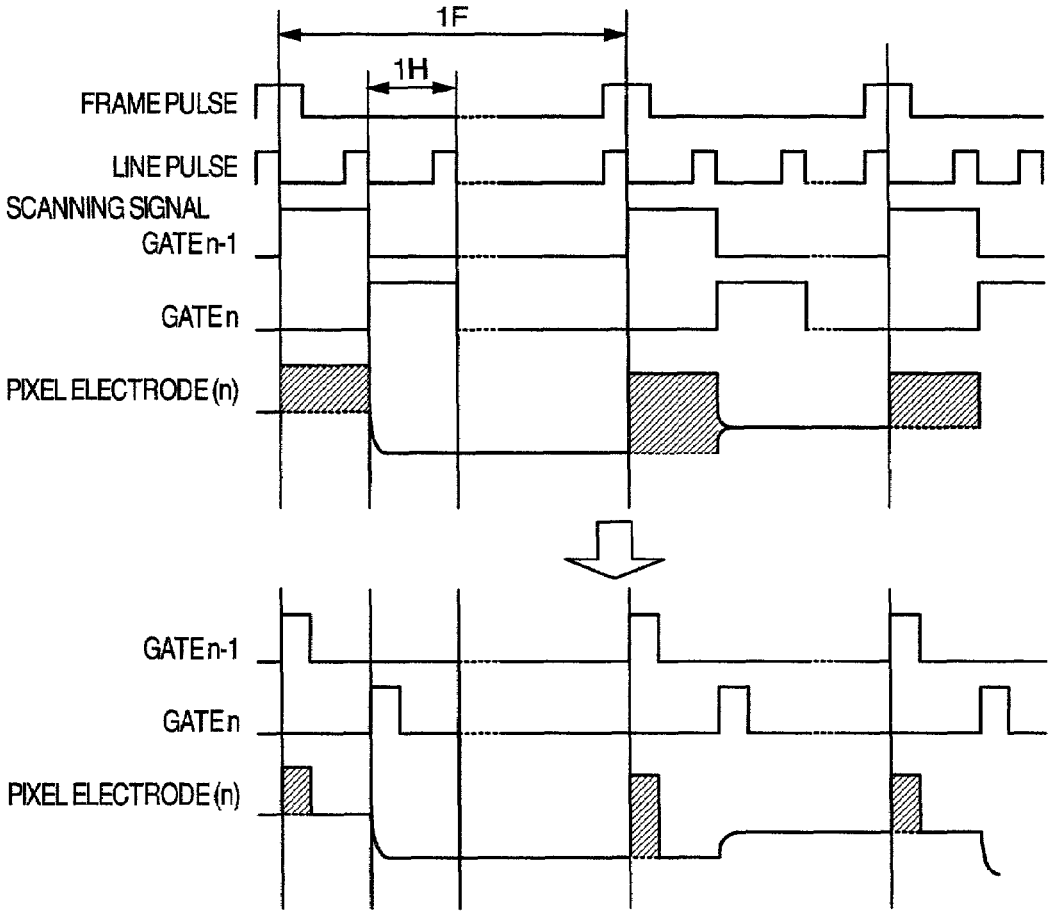
FIG. 2 is a timing chart showing the operation of a gate line drive circuit according to a first embodiment of the invention.

FIG. 2 shows voltage waveforms applied to the liquid crystal of the Cadd structure with the gate pulse width reduced. Also in this case, the fact that the liquid crystal panel 1 has a Cadd structure increases the applied potential to a high level at the time of applying a gate pulse in the preceding ((n−1)th) stage. By reducing the gate pulse width, however, the applied voltage remains at high potential level for a shorter length of time, thereby reducing the abnormal increase of the effective value.

Figure 3:
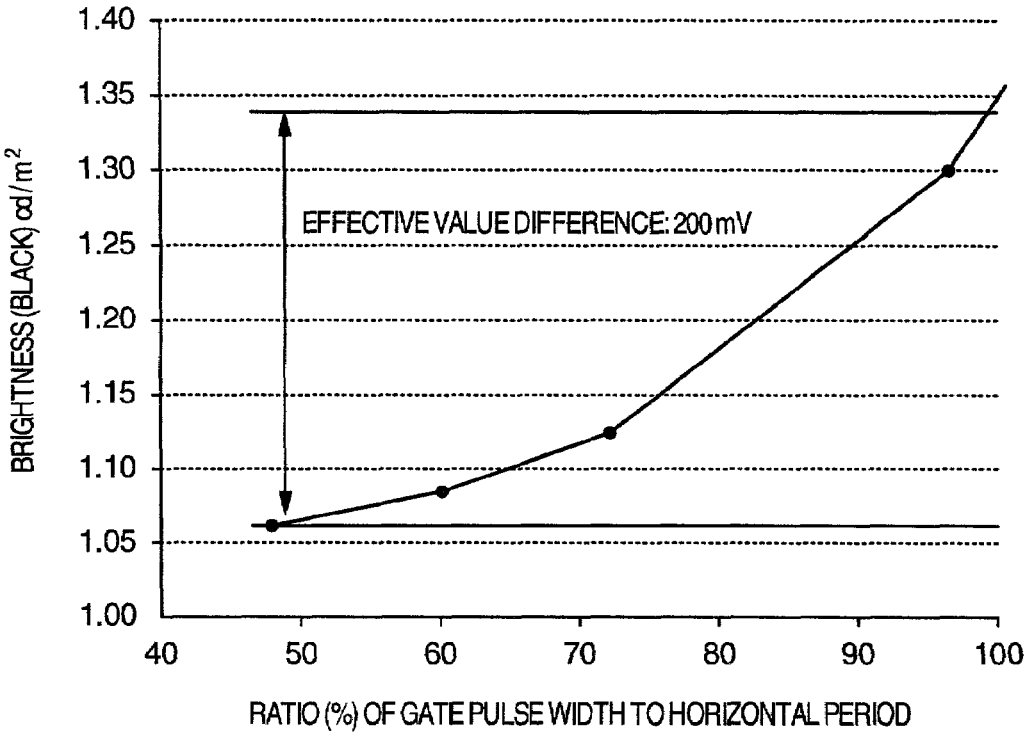
FIG. 3 is a diagram showing the relation between the gate pulse width and the display brightness based on the evaluation of an actual apparatus according to the first embodiment of the invention.

FIG. 3 shows the relation between the ratio of the gate pulse width to one horizontal period and the brightness characteristic on the assumption that 162 lines are driven. Comparison between a gate pulse width equal to one horizontal period as in the prior art and a gate pulse having a period longer by 50% shows the display brightness difference of 200 mV in terms of effective voltage value. In other words, it has been found from the evaluation of actual apparatuses that a value nearer to the target display brightness can be achieved by reducing the gate pulse width. One horizontal period is defined as the interval between the line pulse signals, i.e. the time period from the fall (or the rise) of the line pulse signal to the next fall (or the next rise).

In the gate line drive circuit according to the invention, therefore, the gate pulse width is reduced while at the same time making it possible to adjust the pulse width.

Figure 4:
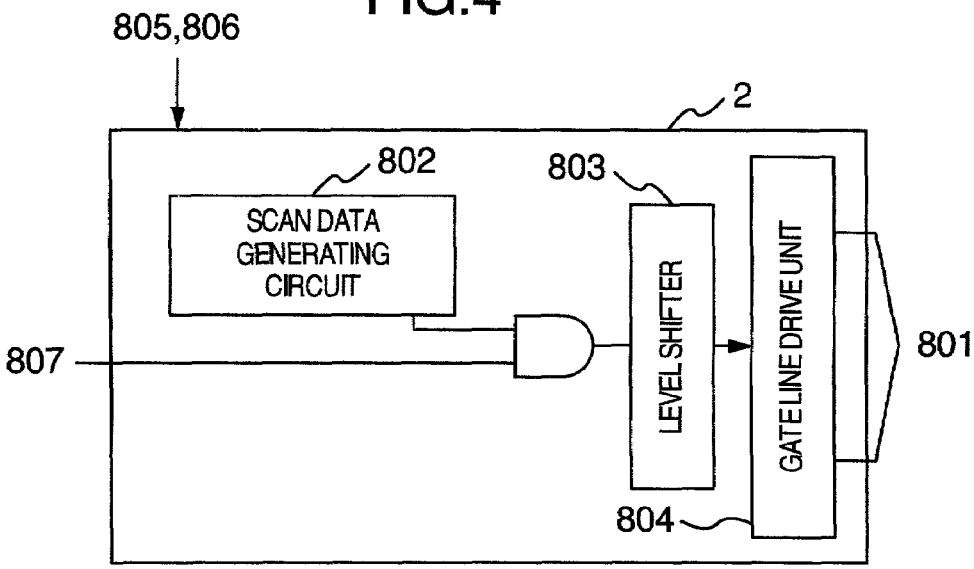
FIG. 4 is a block diagram showing a configuration of the gate line drive circuit according to the first embodiment of the invention.
Figure 5:
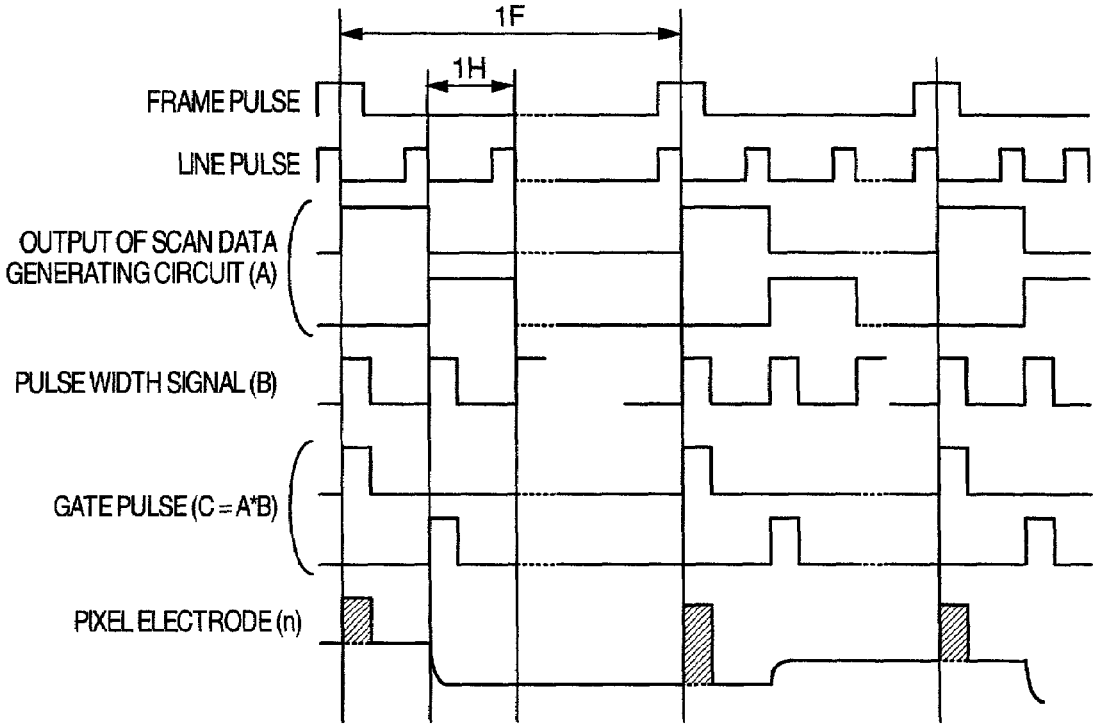
FIG. 5 is a timing chart showing the operation of the gate line drive circuit according to the first embodiment of the invention.

FIG. 4 is a block diagram showing a gate line drive circuit according to a first embodiment of the invention. Reference numeral 801 designates a gate pulse signal, numeral 802 a scan data generating circuit for generating scan data, numeral 803 a level shifter, numeral 804 a gate line drive unit for outputting a gate pulse, numeral 805 a line pulse signal, numeral 806 a frame pulse signal and numeral 807 a pulse width signal. The gate driver 2 is supplied with the line pulse signal 805, the frame pulse signal 806 and the gate pulse width signal 807. The period of the pulse width signal 807 is equal to one horizontal period, and the high-level width (the time width during which the signal remains at high level) thereof is equal to the gate pulse width.

Based on the frame pulse signal 806 and the line pulse signal 805 input thereto, the scan data generating circuit 802 generates a timing of application of a gate line select voltage. In the case under consideration, the gate line select voltage is applied to the head line in synchronism with the trailing edge of the line pulse signal 805 when the frame pulse signal is at high level. After that, the gate line select voltage is applied to the next and subsequent lines sequentially in synchronism with the line pulse signal 805. The high-level width of the output scan data is equal to one horizontal period.

The equation 1 described below is calculated with the scan data A output from the scan data generating circuit 802 and the pulse width signal 807B input from an external source thereby to generate a gate pulse C.

$$C=A*B \tag{1}$$

The level shifter 803 shifts the level from the operating power Vcc-GND of a logic circuit to the operating power VGH-VGL of the gate line drive unit 804.

The gate line drive unit 804 is supplied with the signal changed by the level shifter 803, and buffers and outputs the select voltage VGH and the non-select voltage VGL supplied from the power supply circuit 4. The gate pulse signal becomes the select voltage VGH at high level, and the non-select voltage VGL at low level, or vice versa. The select voltage VGH and the non-select voltage VGL each desirably have a constant amplitude. The period during which the select voltage VGH is turned off is equal to the period during which the non-select voltage VGL is turned on.

Due to the configuration and operation described above, the liquid crystal gate driver 2 according to the first embodiment of the invention can reduce the gate pulse width below one horizontal period, so that the voltage applied to the liquid crystal assumes an effective value nearer to the ideal value. Also, the gate pulse width can be adjusted by changing the high-level width of the pulse width signal applied from an external source. As a result, the proper contrast can be achieved as intended by the invention.

A gate line drive circuit according to a second embodiment of the invention will be explained with reference to FIGS. 6 to 9.

Figure 6:
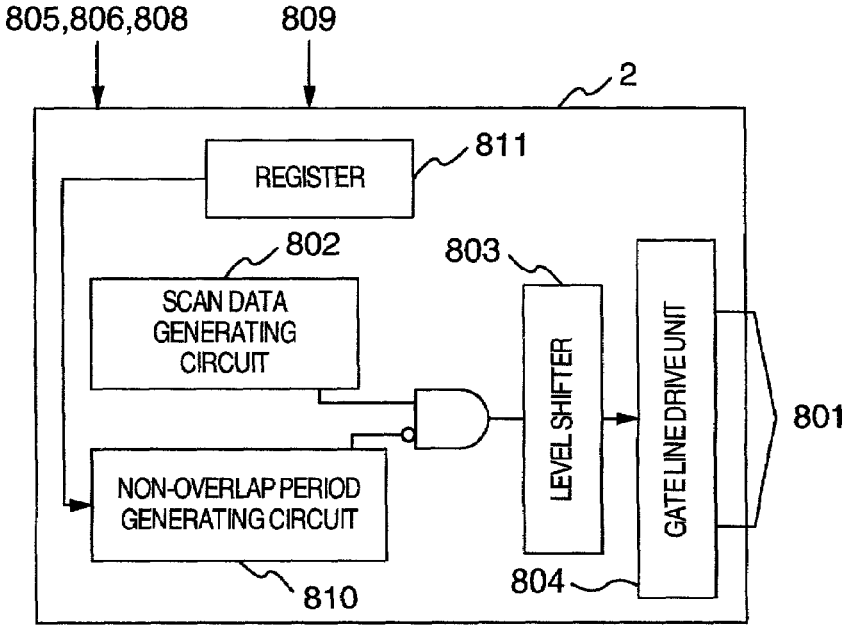
FIG. 6 is a block diagram showing a configuration of the gate line drive circuit according to a second embodiment of the invention.

FIG. 6 is a block diagram showing the gate line drive circuit according to the second embodiment of the invention. According to this invention, the gate pulse width is reduced by providing a non-overlap period (the period during which the select voltage is not input to any gate line). The gate pulse width can be varied by making the non-overlap period adjustable.

Numeral 808 designates a reference clock signal, numeral 809 information on a non-overlap period during which the select voltages for all the gate lines turn off, numeral 810 a non-overlap period generating unit for generating a non-overlap period waveform, and numeral 811 a register for storing the non-overlap period information 809. In place of the non-overlap period, the non-overlap timing (the timing of the gate pulse fall) may be set in a register. Also, in place of the non-overlap period, the time length may be set for which a select voltage is applied in one horizontal period.

The gate driver 2 is supplied with the reference clock signal 808, the line pulse signal 805, the frame pulse signal 807 and the non-overlap period information 809. The non-overlap period is defined by the number of reference clocks, and therefore the non-overlap period information 809 is a designated number of reference clocks.

The non-overlap period information 809 input from an external source is first stored in the register 811. The number of the reference clocks indicating the non-overlap period information 809 thus stored is used by the non-overlap period generating unit 810. In other words, the non-overlap period information 809 represents the number of reference clocks for determining the non-overlap period.

The non-overlap period generating unit 810 generates a non-overlap period waveform E based on the reference clocks and the number of the reference clocks constituting the non-overlap period information 809. This waveform E is a signal including Vcc indicating the non-overlap period 809 and GND indicating the other period. The scan data D output from the scan data generating circuit 802 and the output E of the non-overlap period generating unit are used to carry out the calculation of the following equation 2, thereby producing a target gate pulse F.

$$F=D*\overline{E} \tag{2}$$

The level shifter 803 changes the level of the gate pulse F from the operating power Vcc-GND for the logic circuit to the operating power VGH-VGL for the gate line drive unit 804.

The gate line drive unit 804 is supplied with a signal converted by the level shifter 803, and buffers and outputs the select voltage VGH and the non-select voltage VGL supplied from the power supply circuit 4.

Next, the operation of the non-overlap period generating unit 810 will be explained in more detail.

Figure 7:
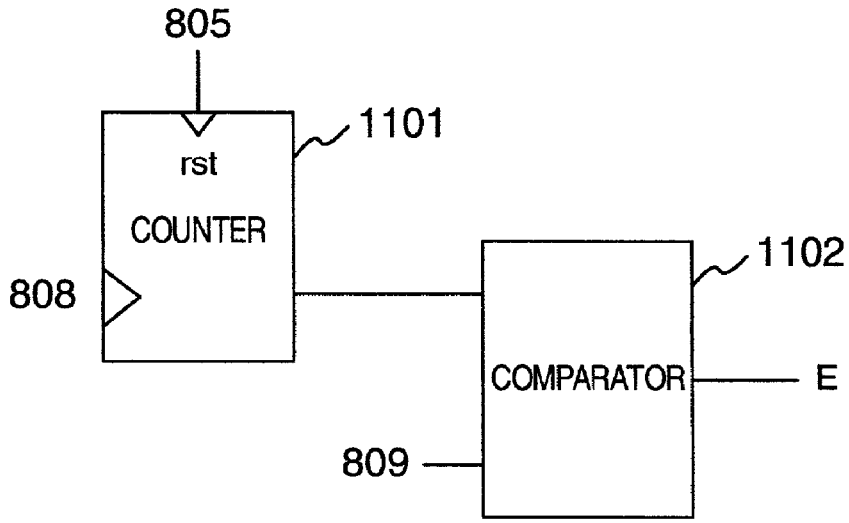
FIG. 7 is a block diagram showing a configuration of a non-overlap period generating section of the gate line drive circuit according to the second embodiment of the invention.

FIG. 7 is a block diagram showing the non-overlap period generating unit 810. The non-overlap period generating unit 810 includes a counter 1101 and a comparator 1102. The counter 1101 is reset at the trailing edge of the output of a line counter. The counter 1101 may alternatively be reset at the leading edge of the output of the line counter.

The reference clocks 808 are counted by the counter 1101 to produce a count a which is compared with the number m of the clocks during a set non-overlap period. In the case where m is not smaller than a, the signal Vcc indicating the non-overlap period is output, and in the case where m is smaller than a, the signal GND is output. As understood from the time chart of the input/output signal of the non-overlap period generating unit 810 shown in FIG. 9, the output E of the non-overlap period generating unit 810 is a pulse signal having a period equal to one horizontal period and a high-level width defined by the set number of reference clocks.

The scan data A has a high-level width equal to one horizontal period, and changes from low to high level in one frame pulse period. The pulse width signal B has a high-level width shorter than one horizontal period, and changes from low to high level in one horizontal period. The gate pulse C also has a high-level width shorter than one horizontal period and changes from low to high level in on frame period. The timing of this gate pulse C changing to high level lags one horizontal period behind that of the gate pulse C in the preceding stage.

Figure 8:
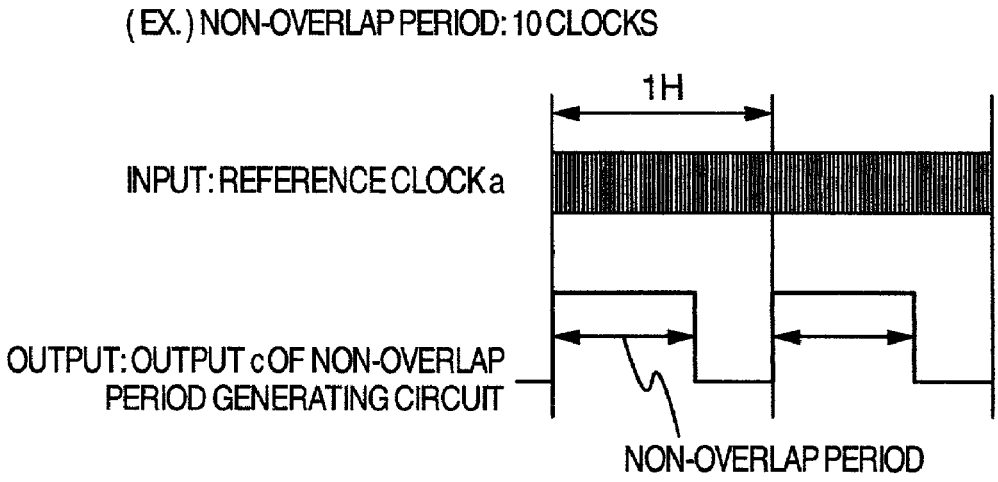
FIG. 8 is a timing chart showing the operation of the non-overlap period generating section of the gate line drive circuit according to the second embodiment of the invention.

FIG. 8 is a timing chart showing the operation of the non-overlap period generating unit. The non-overlap period corresponds to ten reference clocks a. The non-overlap period is shorter than one horizontal period (1 H).

Figure 9:
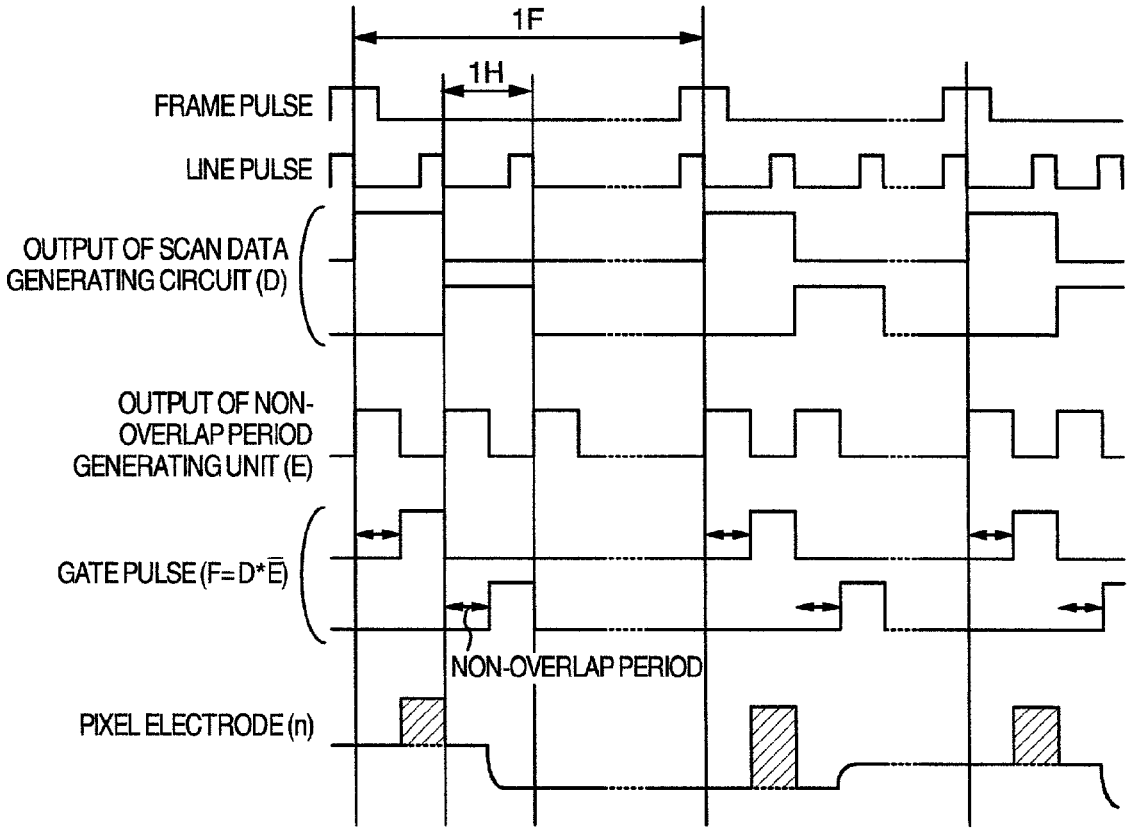
FIG. 9 is a timing chart showing the operation of the gate line drive circuit according to the second embodiment of the invention.

The timing chart of the frame pulse signal 806, the line pulse signal 805, the output of the scan data generating circuit, the output of the non-overlap period generating unit, the gate pulse and the voltage applied to the liquid crystal are summarily shown in FIG. 9. The output F of the gate line drive circuit 804 is obtained from the calculation of equation 2 based on the output D of the scan data generating circuit 802 and the output E of the non-overlap period generating unit 810. Thus, the fluctuation of the voltage applied to the liquid crystal can be suppressed to the values defined by the hatched portion in FIG. 9. As shown in FIG. 9, as long as the output E of the non-overlap period generating unit is at high level, the gate pulse F assumes a low level, while as long as the output E of the non-overlap period generating unit is at low level, the gate pulse F assumes a high level.

With the configuration and the operation described above, in the liquid crystal gate driver 2 according to the second embodiment of the invention, the effective value of the voltage applied to the liquid crystal can be set nearer to the ideal value by arbitrarily changing the gate pulse width by setting the number of reference clocks appropriately during the non-overlap period. In this way, the proper contrast can be achieved as intended by the invention. Next, the gate line drive circuit according to a third embodiment of the invention will be explained with reference to FIGS. 10 to 15.

The conventional liquid crystal drive unit has the function called the partial display by partial LCD drive for displaying only a part of the panel. If the whole screen is scanned in partial display mode, however, power is wasted by scanning the non-display area.

Figure 11:
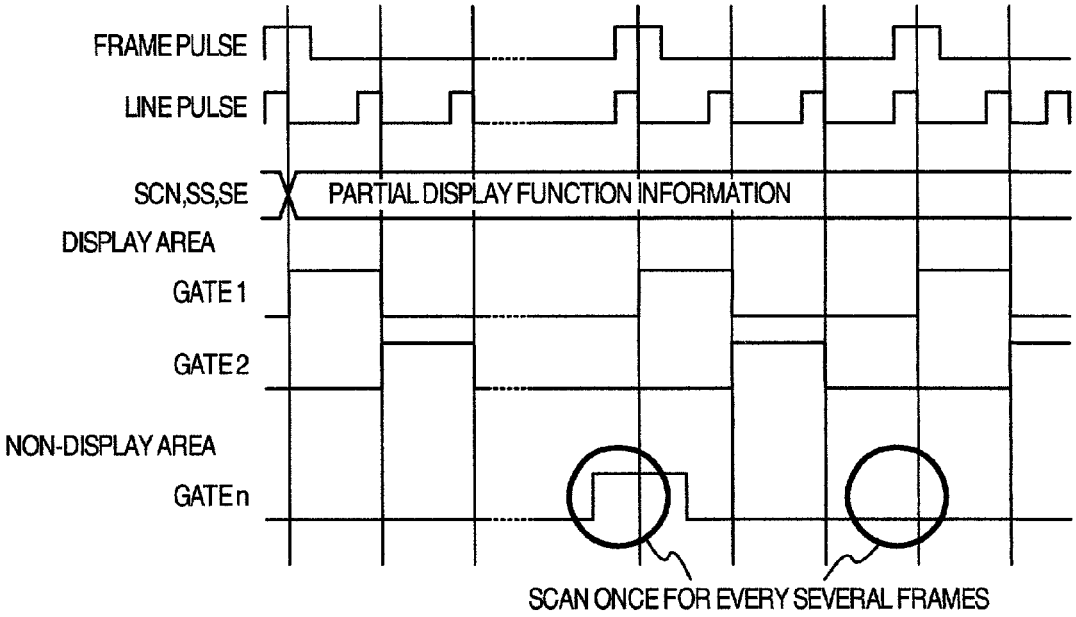
FIG. 11 is a timing chart showing the operation of the gate line drive circuit.

In view of this, as shown in FIG. 11, this embodiment is designed to reduce the power consumption by scanning the non-display area in a slower cycle than the display area.

Figure 10:
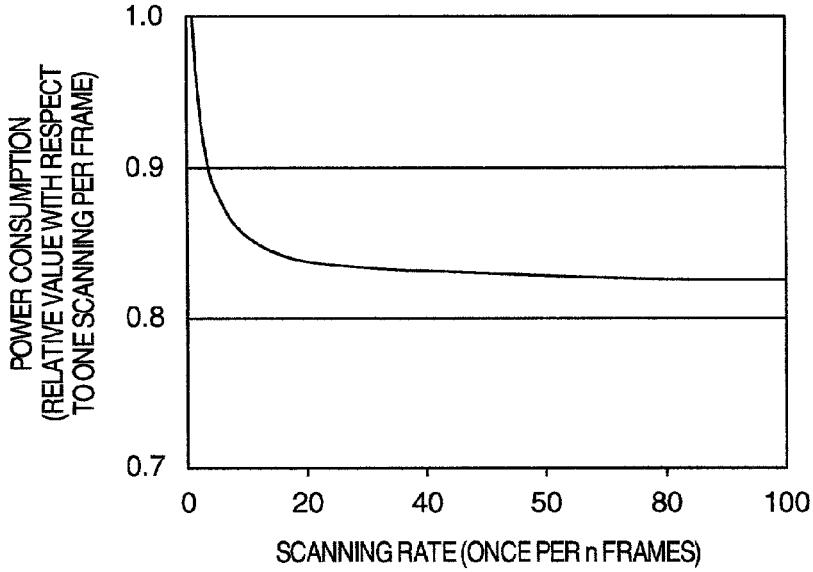
FIG. 10 is a diagram showing the relation between the scanning rate and the power consumption.

First, FIG. 10 shows the relation between the scanning rate (once for every n frames) and the power consumption by charge/discharge of the panel. The power consumption is expressed as 1 for the scanning rate of once per frame. It is noted from FIG. 10 that the power consumption can be effectively reduced by decreasing the scanning rate of the non-display area in the range of not more than once for every 20 frames. With the reduction in scanning rate, however, the non-scanning period is increased, so that the DC voltage is applied due to the gate leak, thereby deteriorating the image quality. In view of this, the scanning rate can be adjusted appropriately by setting.

Figure 12:
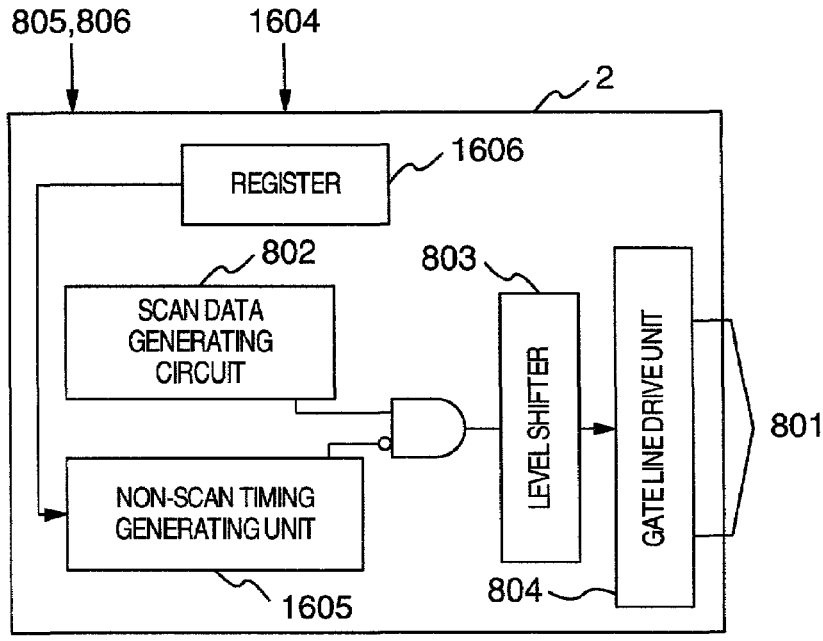
FIG. 12 is a block diagram showing a configuration of the gate line drive circuit according to a third embodiment of the invention.

FIG. 12 is a block diagram showing the gate line drive circuit according to a third embodiment of the invention.

Numeral 1604 designates a partial LCD drive function information for partial display, numeral 1605 a non-scan timing generating unit for generating a non-scan timing for partial display, and numeral 1606 a register for storing the partial LCD drive function information 1604.

The gate driver 2 is supplied with the frame pulse signal 806, the line pulse signal 805 and the partial LCD drive function information 1604. The partial LCD drive function information 1604 includes a start line SS and an end line SE of the display area, and a scanning rate SCN of the non-display area (n=SCN). In the description that follows, the scanning rate is assumed to be once for every n frames.

The partial LCD drive function information 1604 input from an external source is stored in the register 1606. The data on the start line SS and the end line SE of the display area and the scanning rate n of the non-display area constituting the partial LCD drive function information 1604 thus stored are used in the non-scan timing generating unit 1605. The content of the register 1606 is desirably rewritten (reset) in the case where the partial LCD drive function information 1604 is stored therein.

The non-scan timing generating unit 1605 is supplied with the frame pulse signal 806, the line pulse signal 805, the start line SS and the end line SE of the display area and the scanning rate n. First, the non-scan timing generating unit 1605 generates a non-display line signal G including GND indicating a display line and Vcc indicating a non-display line from the line pulse signal 805 and the display area data on the one hand, and a non-display scan signal H including Vcc indicating a frame for scanning the non-display area and GND indicating a frame for not scanning the non-display area from the frame signal 806 and the scanning rate n (scanning once per every n frames) on the other hand. The non-display line signal G and the non-display scan signal H are used to carry out the calculation of the following equation 3, so that a non-scan timing signal I is output with the scan period of GND and the non-scan period of Vcc.

$$I=G*\overline{H} \tag{3}$$

Figure 13:
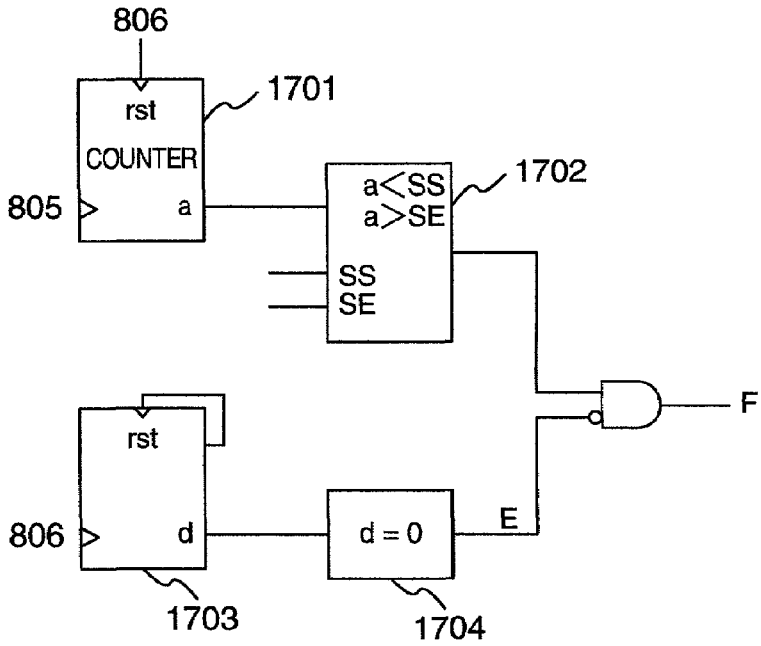
FIG. 13 is a block diagram showing a configuration of a non-scan timing generating section of the gate line drive circuit according to the third embodiment of the invention.

FIG. 13 is a block diagram showing a non-scan timing generating unit 1605. The non-scan timing generating unit 1605 includes a line counter 1701, a comparator 1702, a n-ary counter 1703 and a comparator 1704. The signal G indicating a display line and a non-display line in the frame is generated by the line counter 1701 and the comparator 1702. The counter 1701 is configured to be reset at the leading edge of the frame pulse. Nevertheless, the counter 1701 may be so configured as to be reset at the trailing edge of the frame pulse. The line pulse signal 805 is counted by the counter 1701, and compared with the start line SS and the end line SE. As a result, the non-display area waveform G is output, which includes Vcc indicating a non-display line when the line pulse LP is smaller than the start line SS or larger than the end line SE on the one hand, and GND indicating a display line when the line pulse LP is between the start line SS and the end line SE inclusive, on the other hand. The signal H indicating the scan and non-scan frames of the non-display area is generated by the n-ary counter 1703 and the comparator 1704. The frame pulse signal 806 is counted by the n-ary counter 1703, and compared with the set scanning rate n. As a result, the non-display area scan signal H is output, which includes Vcc indicating scanning in the non-display area in the case where the counter 1703 is reduced to 0, on the one hand, and GND indicating non-scanning in the non-display area in the case where the counter 1703 assumes other values, on the other hand.

Further, the calculation of equation 3 described above is carried out using the non-display area waveform G and the non-display area scan signal H thereby to generate the non-scan timing waveform I from a non-scan timing generating unit 1605.

Figure 14:
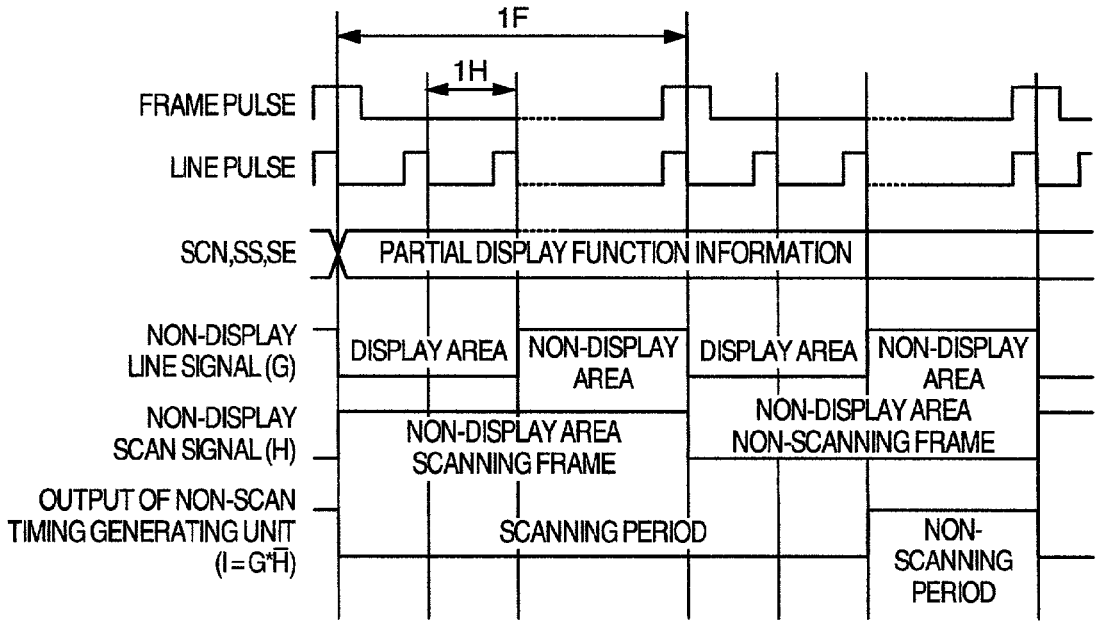
FIG. 14 is a timing chart showing the operation of a non-scan timing generating section of the gate line drive circuit according to the third embodiment of the invention.

As an example, FIG. 14 shows a time chart for the non-scan timing generating unit 1605 with two lines displayed and third and following lines not displayed.

Also, the equation 4 below is calculated using the non-scan timing waveform I and the scan data J, thereby producing a gate pulse K for the gate drive circuit 1601.

$$K=J*\overline{I} \tag{4}$$

Figure 15:
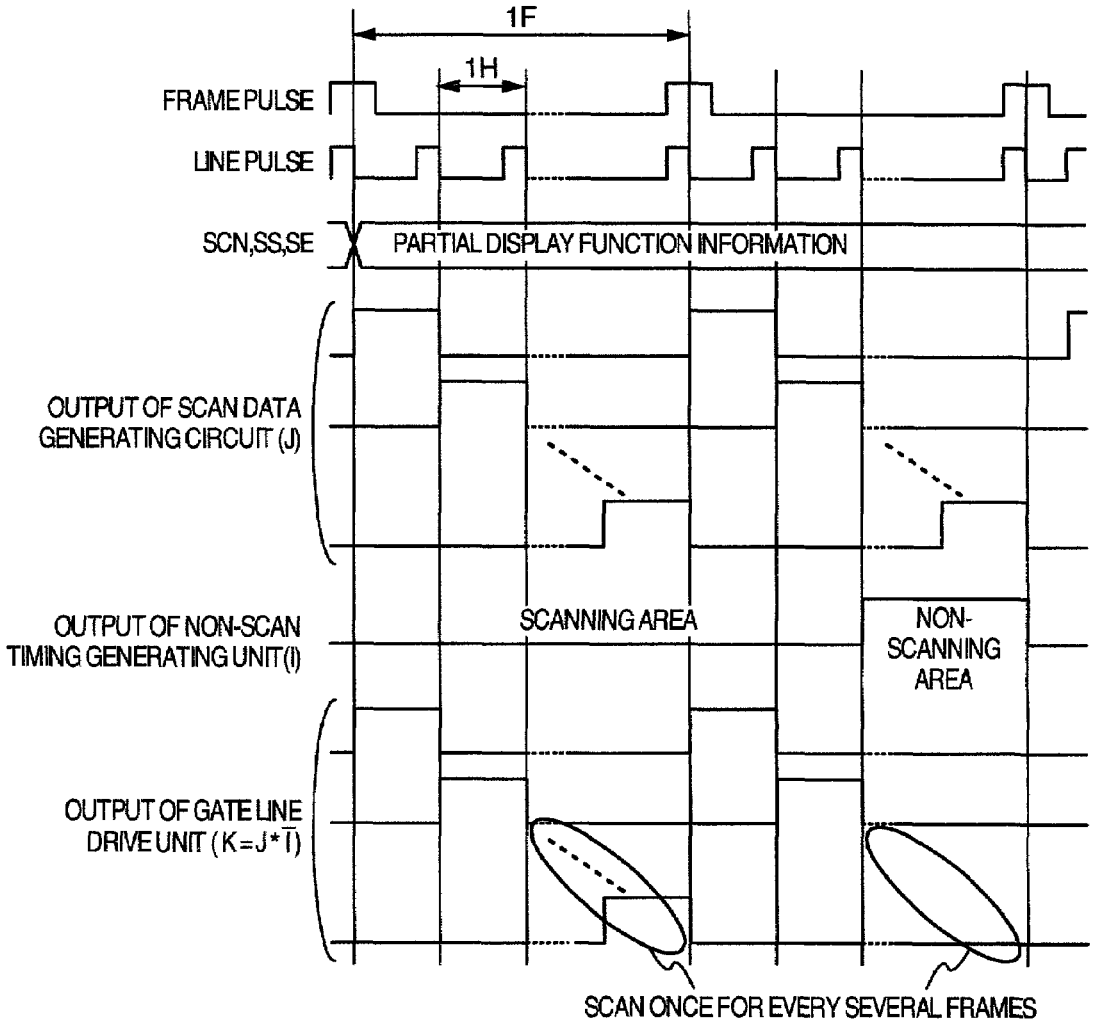
FIG. 15 is a timing chart showing the operation for driving the gate lines according to the third embodiment of the invention.

The frame pulse, the line pulse, the output of the scan data generating circuit, the output of the non-scan timing generating unit and the gate pulse are collectively shown in the timing chart of FIG. 15.

With the configuration and operation described above, the liquid crystal gate driver 2 according to the third embodiment of the invention reduces the scanning rate of the non-display area. The power consumption by charge/discharge of the gate lines can be reduced, for example, by scanning once for every several frames. The reduced power consumption intended for by the invention can thus be achieved.

The embodiments of the invention described above can be combined to realize the proper contrast and lower power consumption.

The registers 809 and 1604 are incorporated in the non-volatile memory of the CPU. The CPU reads the values of the registers from the non-volatile memory, and sets them in the registers 809 and 1604, respectively.

The gate driver 2 according to an embodiment of the invention makes it possible to set a non-overlap period for adjusting the high-level width of the scanning signal, while defining and adjusting the same period by the number of reference clocks. As a result, the effective value of the voltage applied to the liquid crystal is less subjected to fluctuations and brought nearer to an ideal value, thereby producing the proper contrast. Further, the partial LCD drive function can set and adjust the scanning rate of the non-display area. By reducing the scanning rate this way, the gate lines of the non-display area are charged/discharged less frequently, thereby reducing the power consumption.

The embodiments of the invention are most suitable for driving a small-sized liquid crystal panel having a small number of lines. Nevertheless, a similar effect can be obtained in applications to a middle or large liquid crystal panel.

According to this invention, the contrast of the display image can be improved by securing the proper gate pulse width.

Also, according to this invention, the number of times the gate lines of the non-display area are charged/discharged is reduced, thereby reducing the power consumption of the liquid crystal drive unit.

It should be further understood by those skilled in the art that the foregoing description has been made on embodiments of the invention and that various changes and modifications may be made without departing from the spirit of the invention and the scope of the appended claims.

What is claimed is:

1. A display apparatus for displaying display data, comprising:

a display panel, including a plurality of pixels which are arranged in a matrix;

a data driver to apply a gray scale voltage in accordance with said display data to said display panel;

a scan driver for in turn selecting lines of said pixels to be applied with said gray scale voltage; and a register setting a non-overlap period during one horizontal period;

wherein said scan driver selects a line of said pixels to be applied with said gray scale voltage, once per frame period and once per a horizontal period, for a shorter time than the one horizontal period, and next, selects another line of said pixels to be applied said gray scale voltage, once per said frame period and once per a following horizontal period, for a shorter period than the following horizontal period, wherein said non-overlap period is an interval present between an end of selecting said line of the pixels to be applied with the gray scale voltage and a start of selecting the another line of said pixels to be applied with said gray scale voltage, and wherein said non-overlap period is variable in accordance with a setting to said register.

2. A display apparatus according to claim 1, wherein said non-overlap period varies with an input of partial display functioning information for discriminating a period associated with said display area for displaying said display data, and a period associated with a non-display for prohibiting the display of said display data.

3. A display apparatus according to claim 1, wherein the another line of said pixels to be applied with said gray scale voltage next is adjacent to the line of said pixels to be applied with said gray scale voltage.

4. A display apparatus according to claim 1, wherein a pixel includes a pixel electrode, a switch connected to a drain line connected with said pixel electrode and said data driver and a gate line connected with said scan driver, and a capacitor connected between a gate line adjacent to said gate line connected to said switch and said pixel electrode.

5. A display apparatus according to claim 1, wherein said data driver outputs said gray scale voltage to each pixel through a drain line;

wherein said scan driver outputs a selecting voltage to said pixel through a gate line in a case of selecting the line of said pixel, and outputs a non-selecting voltage to the line of said pixel through said gate line in a case of non-selecting the line of said pixel; and wherein said scan driver outputs said non-selecting voltage in said non-overlap period to all the lines of said pixels of said display panel through said plurality of gate lines.

6. A display apparatus according to claim 5, wherein said scan driver includes a generating circuit for generating, at every one line of said pixels, a gate pulse signal varying with one horizontal period and having a level width of either a high level or a low level in a level period of said pulse signal, in accordance with a data signal varying with said one horizontal period and having a level width of either a high level or low level in said one horizontal period, and a pulse signal varying with said one horizontal period and having a level width of either a high level or a low level in a shorter period than said one horizontal period, and a gate line driving circuit for outputting said selecting voltage and said non-selecting voltage to said pixels in accordance with said gate pulse signal;

wherein said gate line driving circuit outputs said selecting voltage to the line of said pixel during a period of one level width of said pulse signal during said one horizontal period, and outputs said non-selecting voltage to the line of pixel during the period of another level width of said pulse signal during said one horizontal period; and wherein said non-overlap period is a period other than the level width of said pulse signal during said one horizontal period.

7. A display apparatus according to claim 5, wherein said scan driver includes a generating circuit for generating a non-overlap period signal varying with said one horizontal period and having a level of either a high level or a low level in a shorter width period than said one horizontal period, a generating circuit for generating, at every one line of said pixels, a gate pulse signal varying with said one horizontal period and having a level width of either a high level or a low level in a difference period between said horizontal period and a non-overlap period in accordance with a data signal and said non-overlap period signal varying with said one frame period and having a level of either a high level or a low level in said one horizontal period, and a gate line driving circuit for outputting said selecting voltage and said non-selecting voltage to the line of said pixels in accordance with said gate pulse signal, and wherein said gate line driving circuit outputs said selecting voltage to the line of said pixels during a period of one level of said gate pulse signal in said one horizontal period and outputs said non-selecting voltage to every line of said pixels during said non-overlap period of another level of said gate pulse signal in said one horizontal period.

8. A display apparatus according to claim 7, wherein said scan driver includes a generating circuit for generating said data signal in accordance with a frame pulse signal varying with one frame period and a line pulse signal varying with one horizontal period, and a generating circuit for generating said non-overlap period signal in accordance with said non-overlap period set in said register.

9. A display apparatus according to claim 1, wherein said scan driver includes a generating circuit for generating said data signal for every one line of said pixel in accordance with a frame pulse signal varying with said one frame period and a line pulse signal varying with said one horizontal period.

10. A display apparatus according to claim 9, wherein said display panel includes a display area for displaying said display data and a non-display area prohibiting display of display data; and wherein a frequency of said gate pulse signal is high during a period associated with said display area and low during a period associated with said non-display area.

11. A display apparatus according to claim 10, wherein a scanning frequency caused by said gate pulse signal during a non-display period is less than a scanning frequency caused by said gate pulse signal during a display area period.

12. A display apparatus according to claim 11, wherein said register sets a number of reference clocks to determine said non-overlap period of and wherein a non-overlap period generating circuit generates said non-overlap period signal based on a reference clock signal and said number of reference clocks.

13. A display apparatus according to claim 1, wherein said non-overlap period is externally adjustable by setting said register.

14. A display apparatus according to claim 1, wherein said scan driver does not select any lines of said pixels during said non-overlap period.

15. A display apparatus according to claim 1, wherein a period for selecting said line of the pixels becomes short by said scan driver in said horizontal period, in proportion to said non-overlap period becoming longer.

16. A display apparatus according to claim 1, wherein a period for selecting said line of the pixels becomes short by said scan driver in said horizontal period in proportion to becoming said non-overlap period longer.

17. A display apparatus according to claim 1, wherein said non-overlap period is not in a horizontal blanking period.

18. A display apparatus for displaying display data, comprising:

a display panel including a plurality of drain lines and a plurality of gate lines, both of which intersect one another, respectively, and a plurality of pixels arranged on intersected parts of said plurality of drain lines and said plurality of gate lines;

a data driver for applying a gray scale voltage in accordance with said display data to said pixels on said display panel through said drain lines;

a scan driver for in turn outputting a selection voltage to a line of said pixels through said gate lines such that said pixels to be applied with said gray scale voltage are selected in turn every line; and a register for setting an interval between an end of selecting said line of the pixels to be applied with said gray scale voltage and a start of selecting another line of the pixels to be applied said gray scale voltage next, said interval being a non-overlap period, and said non-overlap period as present in one horizontal period is set by said register, wherein said scan driver selects said line of said pixels once per a frame period and once per a horizontal period, for a shorter period than the one horizontal period.

19. A display apparatus according to claim 18, wherein said non-overlap period is externally adjustable by setting said register.

20. A display apparatus according to claim 18, wherein said scan driver does not select any lines of said pixels during said non-overlap period.

21. A display apparatus according to claim 18, wherein said pixel includes a pixel electrode, a switch connected to said pixel electrode, said drain line and a gate line, and a capacitor connected between a gate line adjacent to said gate line connected to said switch and said pixel electrode.

22. A display apparatus according to claim 18, wherein a transistor sets a number of clocks for determining said non-overlap period.

23. A display apparatus according to claim 18, wherein said non-overlap period is not in a horizontal blanking period.

* * * * *